US011787658B2

(12) United States Patent
Nakahara et al.

(10) Patent No.: US 11,787,658 B2
(45) Date of Patent: Oct. 17, 2023

(54) SHEET PROCESSING APPARATUS

(71) Applicant: CANON KABUSHIKI KAISHA, Tokyo (JP)

(72) Inventors: Yasuhiro Nakahara, Kanagawa (JP); Noriyuki Monden, Shizuoka (JP); Takahiro Endo, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/712,778

(22) Filed: Apr. 4, 2022

(65) Prior Publication Data

US 2022/0332536 A1 Oct. 20, 2022

(30) Foreign Application Priority Data

Apr. 19, 2021 (JP) ..... 2021-070412

(51) Int. Cl.
*B26F 1/10* (2006.01)
*B65H 43/08* (2006.01)
(Continued)

(52) U.S. Cl.
CPC ..... *B65H 43/08* (2013.01); *B26F 1/10* (2013.01); *B65H 29/125* (2013.01);
(Continued)

(58) Field of Classification Search
CPC .. B65H 43/08; B65H 29/125; B65H 35/0073; B65H 2220/02; B65H 2301/5152;
(Continued)

(56) References Cited

U.S. PATENT DOCUMENTS 5,911,414 A * 6/1999 Kato ..... B26F 1/10 399/407
8,011,649 B2 * 9/2011 Yahata ..... B65H 35/0006 270/58.07

(Continued)

FOREIGN PATENT DOCUMENTS

JP H0678131 B2 10/1994
JP H10194557 A 7/1998

(Continued)

OTHER PUBLICATIONS

Espacenet machine translation of JP2004149265A; http://translationportal.epo.org/emtp/translate/?ACTION=description-retrieval&COUNTRY=JP&ENGINE=google&FORMAT=docdb&KIND=A&LOCALE=en_EP&NUMBER=2004149265&OPS=ops.epo.org/3.2&SRCLANG=ja&TRGLANG=en (Year: 2004).*

*Primary Examiner* — Leslie A Nicholson, III
(74) *Attorney, Agent, or Firm* — ROSSI, KIMMS & McDOWELL LLP

(57) ABSTRACT

A sheet processing apparatus comprising: a conveying unit configured to have a roller that conveys a sheet in a conveyance direction; a first detecting device disposed downstream of the conveying unit in the conveyance direction; a second detecting device disposed downstream of the first detecting device in the conveyance direction; a boring unit configured to have a punch that performs boring in the sheet; and a control unit is used. The first detecting device and the second detecting device each detect passage of a leading edge of the sheet being conveyed. The control unit calculates an actual conveyance speed of the sheet on the basis of detection results of the first detecting device and the second detecting device, and controls rotation of the roller, on the basis of the actual conveyance speed, so that the sheet is conveyed at a predetermined target speed.

12 Claims, 12 Drawing Sheets

(51) Int. Cl.
*B65H 29/12* (2006.01)
*B65H 35/00* (2006.01)

(52) U.S. Cl.
CPC ..... *B65H 35/0073* (2013.01); *B65H 2220/02* (2013.01); *B65H 2301/5152* (2013.01); *B65H 2511/514* (2013.01); *B65H 2513/10* (2013.01); *B65H 2553/82* (2013.01); *B65H 2701/1311* (2013.01); *B65H 2801/27* (2013.01)

(58) Field of Classification Search
CPC ..... B65H 2511/514; B65H 2513/10; B65H 2553/82; B65H 2701/1311; B65H 2801/27; B26F 1/06; B26F 1/10
USPC ..... 271/202, 270; 270/58.07
See application file for complete search history.

(56) References Cited

U.S. PATENT DOCUMENTS 8,091,882 B2 * 1/2012 Iguchi ..... B65H 29/14 270/58.17
8,181,950 B2 * 5/2012 Kato ..... G03G 15/6582 270/58.07
8,693,009 B2 * 4/2014 Furuya ..... G01B 5/043 358/1.14
8,948,681 B2 * 2/2015 Furuya ..... G03G 15/6529 399/376
9,187,276 B2 * 11/2015 Maeshima ..... B41J 11/42
11,086,261 B2 * 8/2021 Endo ..... B65H 43/00
11,279,586 B2 * 3/2022 Nakahara ..... B65H 37/04
11,427,423 B2 * 8/2022 Maeyama ..... B65H 7/08
2005/0212194 A1 * 9/2005 Moriyama ..... B65H 9/103 270/58.08
2019/0161301 A1 * 5/2019 Maeyama ..... B65H 7/08
2021/0011417 A1 * 1/2021 Endo ..... G03G 15/6582

FOREIGN PATENT DOCUMENTS

JP H10218427 A 8/1998
JP 3176436 B2 6/2001
JP 2001151385 A 6/2001
JP 2002068520 A 3/2002
JP 2004142865 A 5/2004
JP 2004149265 A * 5/2004
JP 2007062871 A 3/2007
JP 2017088281 A 5/2017
JP 6540462 B2 7/2019
JP 2021014355 A 2/2021

* cited by examiner

301
S1a
DETAIL A
301a
S1

S1a
301
301b
S1
DETAIL B

4mm
303
DETAIL A
DETAIL B
202
205
302
201
204
301b
301
S1
301a
-46°

-28°

0°

+28°

+46°

PS SIGNAL
H
L

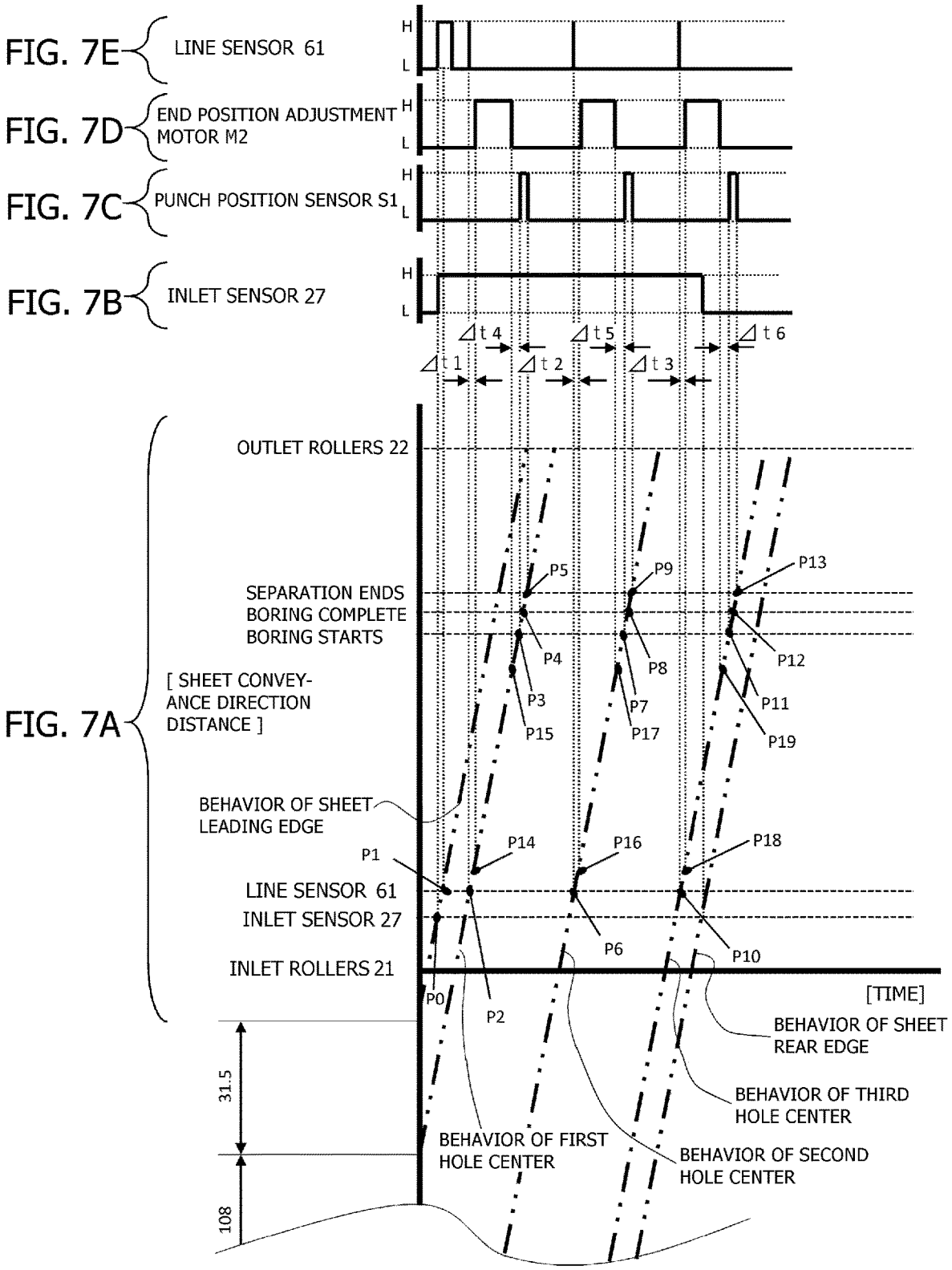
FIG. 7E
LINE SENSOR 61
FIG. 7D
END POSITION ADJUSTMENT MOTOR M2
FIG. 7C
PUNCH POSITION SENSOR S1
FIG. 7B
INLET SENSOR 27
H
L
⊿t 1
⊿t 2
⊿t 3
⊿t 4
⊿t 5
⊿t 6
FIG. 7A
OUTLET ROLLERS 22
SEPARATION ENDS
BORING COMPLETE
BORING STARTS
[ SHEET CONVEYANCE DIRECTION DISTANCE ]
BEHAVIOR OF SHEET LEADING EDGE
LINE SENSOR 61
INLET SENSOR 27
INLET ROLLERS 21
P0
P1
P2
P3
P4
P5
P6
P7
P8
P9
P10
P11
P12
P13
P14
P15
P16
P17
P18
P19
[TIME]
BEHAVIOR OF SHEET REAR EDGE
BEHAVIOR OF THIRD HOLE CENTER
BEHAVIOR OF FIRST HOLE CENTER
BEHAVIOR OF SECOND HOLE CENTER
31.5
108

SHEET PROCESSING APPARATUS

BACKGROUND OF THE INVENTION

Field of the Invention

The present invention relates to a sheet processing apparatus.

Description of the Related Art

Patent Literature 1 (Japanese Patent Application Publication No. 2021-014355) discloses a sheet processing apparatus for boring a sheet while conveying the sheet.

SUMMARY OF THE INVENTION

In a sheet processing apparatus for boring a sheet while the sheet is conveyed it is problematic, in a case of an increased product size and cost involved, to provide a dedicated detecting device for detecting the conveyance speed of the sheet.

It is an object of the present invention, arrived at in the light of the above considerations, to provide a sheet processing apparatus that allows curtailing increases in product volume and increases in cost.

The present invention provides a sheet processing apparatus, comprising:

a conveying unit configured to have a roller that conveys a sheet in a conveyance direction;

a first detecting device disposed downstream of the conveying unit in the conveyance direction;

a second detecting device disposed downstream of the first detecting device in the conveyance direction;

a boring unit configured to have a punch that performs boring in the sheet; and a control unit, wherein the first detecting device and the second detecting device each detect passage of a leading edge of the sheet being conveyed, and the control unit calculates an actual conveyance speed of the sheet on the basis of detection results of the first detecting device and the second detecting device, and controls rotation of the roller, on the basis of the actual conveyance speed, so that the sheet is conveyed at a predetermined target speed.

The present invention also provides a sheet processing apparatus, comprising:

a conveying unit configured to have a roller that conveys a sheet in a conveyance direction;

a detecting device disposed downstream of the conveying unit in the conveyance direction;

a boring unit configured to have a punch that performs boring in the sheet; and a control unit, wherein the detecting device detects passage of a leading edge and a rear edge of the sheet being conveyed, and the control unit calculates an actual conveyance speed of the sheet on the basis of respective timings of passage of the leading edge and the rear edge of the sheet, and a length of the sheet in the conveyance direction, and controls rotation of the roller, on the basis of the actual conveyance speed, so that the sheet is conveyed at a predetermined target speed.

The present invention also provides a sheet processing apparatus, comprising:

a conveying unit configured to convey a sheet in a conveyance direction;

a detecting device that detects, at a plurality of times, an end portion of the sheet in the conveyance direction;

a boring unit configured to have a punch that performs boring in the sheet; and a control unit, wherein the detecting device calculates an actual conveyance speed of the sheet on the basis of respective timings, at which the end portion is detected a plurality of times, and controls the conveying unit, on the basis of the actual conveyance speed, so that the sheet is conveyed at a predetermined target speed.

The present invention is able to provide a sheet processing apparatus that allows curtailing increases in product volume and increases in cost.

Further features of the present invention will become apparent from the following description of exemplary embodiments with reference to the attached drawings.

BRIEF DESCRIPTION OF THE DRAWINGS

FIG. 7A to FIG. 7E are a timing chart of Embodiment 1;

DESCRIPTION OF THE EMBODIMENTS

Embodiments for carrying out the present invention will be illustratively explained in detail below, with reference to accompanying drawings. However, the dimensions, materials, shapes and relative arrangements of the constituent parts described in the embodiments are to be modified as appropriate depending on the configuration of the apparatus to which the invention is applied, and in accordance with various conditions. That is, the scope of the invention is not meant to be limited to the embodiments below.

The present invention can be regarded as a conveyance speed detection device that detects speed at the time of conveyance of sheets such as paper sheets. The present invention can also be regarded as a conveyance device provided with such a conveyance speed detection device. The present invention can also be regarded as a sheet processing apparatus that performs predetermined processing, such as boring and stapling, on a conveyed sheet. Such a sheet processing apparatus may be connected to an image forming apparatus, and may process a sheet on which an image has been formed in the image forming apparatus. In that case the sheet processing apparatus can also be referred to as a paper discharge processing apparatus or a post-processing apparatus. The sheet processing apparatus may constitute part of the image forming apparatus.

EMBODIMENT 1

Specific Configuration and Operation of the Apparatus

Figure 1:
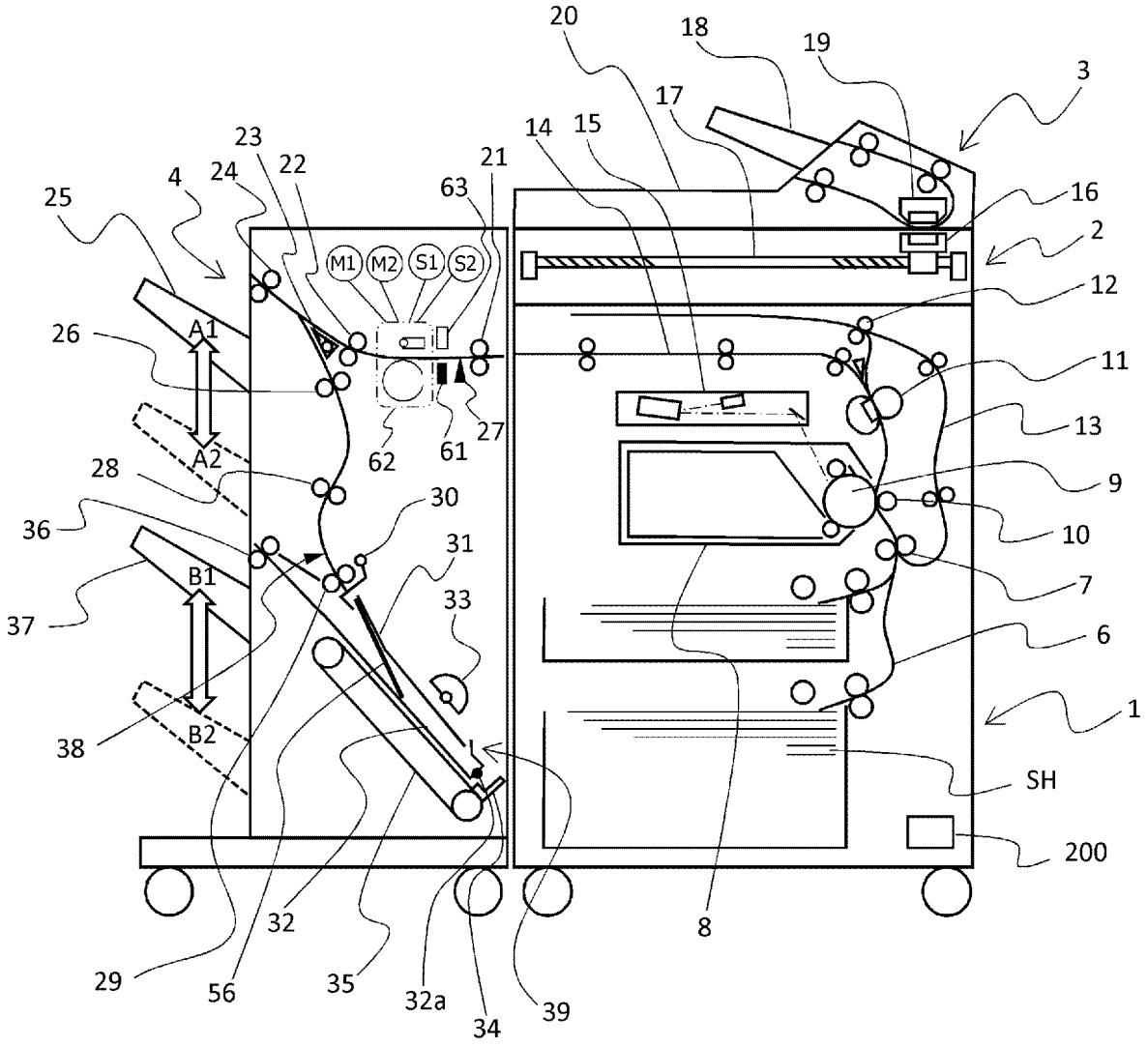
FIG. 1 is a schematic cross-sectional diagram of a sheet processing apparatus and an image forming apparatus of Embodiment 1.

FIG. 1 illustrates a schematic cross section of an image forming apparatus 1, an image reading device 2, a document feeding device 3, and a paper sheet post-processing apparatus 4 (sheet processing apparatus) in which the present invention is realized. A simple operation of each device will be explained first, followed by a detailed explanation of a boring operation in the paper sheet post-processing apparatus 4.

Image Forming Apparatus

A document placed on a document tray 18 of the document feeding device 3 is conveyed to image reading units 16, 19. The image reading units 16 and 19 read the respective facing surfaces of the document; as a result, the image reading units 16 and 19 can complete reading of a double-sided document in one single run of a paper sheet. The document is discharged to a document ejection unit 20. The image reading device 2 allows reading a document for which the document feeding device 3 cannot be used, such as a booklet document, through back-and-forth scanning by the image reading unit 16 prompted by a driving device 17.

An image formation operation is executed then in which images read by the image reading units 16, 19 and images transmitted from a server or computer, not shown, are developed and adjusted by a controller, not shown, provided in the image forming apparatus 1.

The image forming apparatus 1 has disposed therein a plurality of paper feeding devices 6 that accommodate a plurality of paper sheets (sheet SH) and that feed the paper sheets one by one at predetermined feeding intervals. The skew of each paper sheet fed from the paper feeding device 6 is corrected by resist rollers 7; the sheet is then conveyed to a photosensitive drum 9 and to a transfer roller 10, having been charged to a predetermined charge, that are rotatably supported in an image forming cartridge 8. The photosensitive drum 9 goes through steps of exposure, charging, latent image formation and development, in the image forming cartridge, whereby a toner image becomes formed on the surface of the photosensitive drum 9. Latent image formation is accomplished by a laser scanner unit 15 that forms an image through scanning of a polygon mirror with flickering laser light, by way of a lens, in a direction perpendicular to the conveyance direction.

The paper sheet having the toner image formed thereon is fed to a horizontal conveyance unit 14 via a fixing unit 11 that fixes the toner on the paper sheet through heating and pressing of the toner. In the case of double-sided printing, the paper sheet is conveyed once to reversing rollers 12, and is switched back to flip the leading edge and the rear edge of the paper sheet, which is thereafter sent to a re-feeding conveyance unit 13, and conveyed to the resist rollers 7 at a predetermined timing, whereupon second image formation is performed.

The image forming apparatus 1 includes a control unit 200. The control unit 200 is an information processing means that includes computational resources such as a processor and a memory. The control unit 200 controls the operation of various constituent elements such as the image forming apparatus 1, the image reading device 2, the document feeding device 3 and the paper sheet post-processing apparatus 4, on the basis of user instructions inputted by a user, and on the basis of detection information from various sensors. The control unit 200 can function as a below-described computing unit, by utilizing an information processing function. A control unit 200 may be used herein that is shared by the image forming apparatus 1 and the paper sheet post-processing apparatus 4; alternatively, the image forming apparatus 1 and the paper sheet post-processing apparatus 4 may each have a respective unique information processing means. A configuration may be adopted in which a control unit 200 disposed at a location different from that of the image forming apparatus 1 and the paper sheet post-processing apparatus 4 controls the image forming apparatus 1 and the paper sheet post-processing apparatus 4 via a communication means.

Sheet Processing Apparatus

The paper sheet conveyed from the horizontal conveyance unit 14 is handed over by inlet rollers 21 of the paper sheet post-processing apparatus 4 (sheet processing apparatus). In the horizontal conveyance unit 14, a one-way clutch not shown is built in a drive member, not shown, so that conveying rollers idle when the paper sheet is pulled in the same direction as the conveyance direction, for the purpose of absorbing the difference between the conveyance speed in the paper sheet post-processing apparatus 4 and the conveyance speed in the horizontal conveyance unit 14.

A sheet conveyance direction leading edge detecting device 27 is disposed downstream of the inlet rollers 21. The sheet conveyance direction leading edge detecting device 27 detects the passage of the leading edge and the rear edge of the sheet received by the inlet rollers 21, and the presence or absence of jammed paper. For instance a reflective optical sensor, a transmissive optical sensor or a strain detecting sensor that detects strain at a roller nip portion can be used as the sheet conveyance direction leading edge detecting device 27.

A line sensor 61, an illumination unit 63, and a rotary punch unit 62 are disposed downstream of the sheet conveyance direction leading edge detecting device 27. The line sensor 61 and the illumination unit 63 have a function of detecting the ends of the sheet. The rotary punch unit 62 is connected to a boring motor M1, an end position adjustment motor M2, a punch position sensor S1, and a punch end position home position sensor S2. In the present embodiment a stepping motor is used for both a punch 202 and a die 205. In the present embodiment the line sensor 61, the illumination unit 63 and the rotary punch unit 62 are used at the time of sheet boring. A boring/non-boring instruction is inputted from a touch panel, not shown, that is fitted for instance to the image forming apparatus 1, the image reading device 2 or the document feeding device 3. The details of such boring will be described after an overall explanation.

Buffer front rollers 22 accelerate the paper sheet at a predetermined timing on the basis the rear edge passage time by the sheet conveyance direction leading edge detecting device 27. The predetermined timing denotes herein a point in time after completion of boring of a final hole in the sheet, at the time of boring, and denotes a point in time immediately after the rear edge of the sheet has passed, during non-boring. In a case where the discharge destination of the paper sheet is a paper discharge upper tray 25, the paper sheet is decelerated down to a predetermined paper discharge speed, at a stage where the rear edge of the paper sheet has come between the buffer front rollers 22 and reversing rollers 24; the paper sheet is thereupon discharged onto the paper discharge upper tray 25.

In a case where the paper discharge destination is a paper discharge lower tray 37, the paper sheet is temporarily stopped at a timing where the rear edge of the paper sheet passes a check valve that is urged clockwise in the figure by a spring, not shown; the paper sheet is then switched back and conveyed to inner paper discharge rollers 26. When the leading edge of the paper sheet reaches the inner paper discharge rollers 26, the reversing rollers 24 release the nip, and prepare to receive a trailing paper sheet directed at the reversing rollers 24. Driving of the inner paper discharge rollers 26 is temporarily discontinued, in a state where the paper sheet is nipped therebetween; then, the inner paper discharge rollers 26 convey the paper sheet again, in the reverse direction, in time with the passage of the trailing paper sheet. Paper sheet buffering is thus performed through superposition of a leading paper sheet and a trailing paper sheet. Such paper sheet buffering allows a plurality of sheets to be buffered, regardless of the length of the paper sheets, as a result of repeated switchback by the inner paper discharge rollers 26.

The paper sheet conveyed from the inner paper discharge rollers 26 is fed to kicking rollers 29 via intermediate conveying rollers 28, and is conveyed to an intermediate loading section 39 made up of an intermediate loading upper guide 31 and an intermediate loading lower guide 32. A vertical alignment reference plate 32*a* is disposed at the furthest downstream portion of the intermediate loading lower guide 32 in the intermediate loading section 39; herein, paper bundles are aligned through abutting of the end portion of each paper sheet in the conveyance direction against the vertical alignment reference plate 32*a*.

A flexible pressing guide 56 is fixed in the intermediate loading upper guide, and comes in contact with the paper sheet in the intermediate loading section 39, under a predetermined pressing force. A half-moon roller 33 for pushing, into the vertical alignment reference plate 32*a*, the paper sheet having passed the kicking rollers 29, is rotatably supported on the intermediate loading upper guide 31, downstream of the pressing guide 56. After the rear edge of the paper sheet passes an intermediate loading front sensor 38, the half-moon roller 33 conveys the paper sheet towards a vertical alignment reference plate 32*a* at a predetermined timing. The half-moon roller 33 is adjusted to a conveyance pressure so as to slip over the paper sheet after the paper sheet has come into contact with the vertical alignment reference plate 32*a*.

Downstream of the kicking rollers 29 there is rotationally supported a bundle hold-down flag 30 that suppresses lift-up of the rear edge of the paper sheet so that the rear edge of the paper sheet loaded on the intermediate loading section 39 and the leading edge of the trailing paper sheet do not interfere with each other. After the paper sheet has reached the vertical alignment reference plate 32*a*, a horizontal alignment jogger not shown performs an alignment operation on a horizontal alignment reference plate, not shown, to thereby align a paper bundle.

After alignment of a predetermined number of sheets is over, a binding operation is performed by a stapler not shown. Thereafter, a bundle discharge guide 34 connected to a guide drive member 35 moves parallelly, from a standby position, towards bundle discharge rollers 36, to thereby push the paper bundle out.

When the leading edge of the paper bundle reaches the bundle discharge rollers 36, the bundle discharge guide 34 stops, and returns once again to the standby position. The bundle discharge rollers 36 discharge the paper bundle received from the bundle discharge guide 34 onto the paper discharge lower tray 37. The paper discharge upper tray 25 and the paper discharge lower tray 37 sequentially detect the paper sheet surface position by means of respective paper sheet surface detection sensors, not shown, such that when the paper sheets pile up the paper discharge upper tray 25 and the paper discharge lower tray 37 are caused to move in the A2 and B2 directions. Upon detection that loaded paper sheets have been removed, the trays move in the A1 and B1 directions, while controlled so that the height of the top faces of the trays is constant at all times.

Details on the Boring Mechanism

Figure 2A:
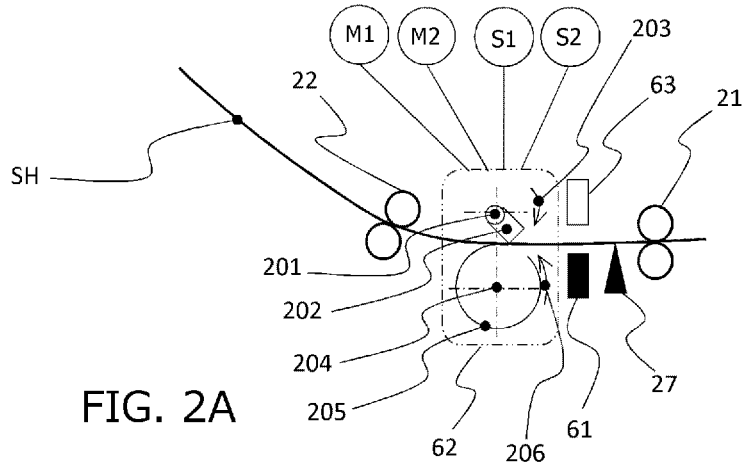
FIG. 2A to FIG. 2C are schematic diagrams for explaining a punch unit.
Figure 2B:
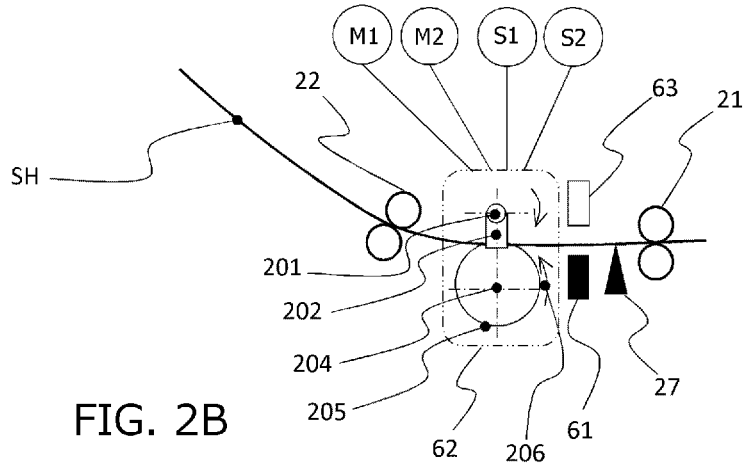
Figure 2C:
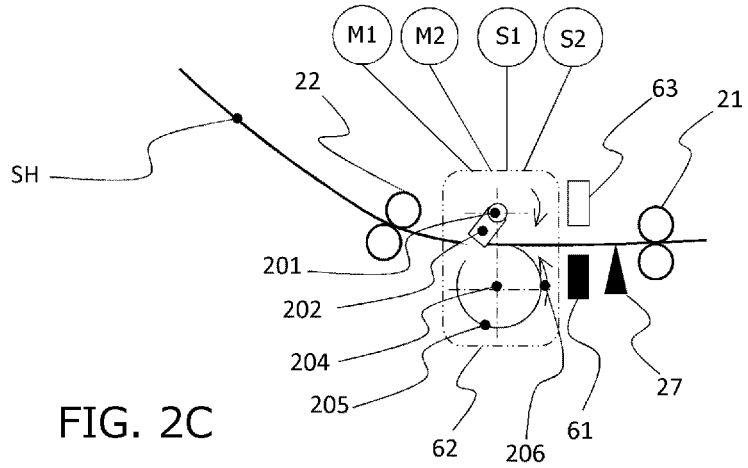

Boring will be explained in detail below. FIG. 2A to FIG. 2C are diagrams illustrating a boring mechanism of the rotary punch unit 62 in Embodiment 1. Hereinafter, a sheet SH will be explained on the premise that the sheet SH is conveyed from the upstream side on the right of the paper in the figure towards the downstream side, on the left.

The rotary punch unit 62 is made up of the punch 202 and the die 205. The reference numeral 201 is the center of the rotating shaft the punch 202, which rotates in the direction of arrow 203. The reference numeral 204 is the center of the rotating shaft of the die 205, which rotates in the direction of arrow 206. Phases are matched so that the leading edge portion of the punch 202 and a hole portion of the die 205 fit with each other.

A gear, not shown, having the purpose of inputting power for boring, is also attached to the rotating shaft of the die 205. A driving force is inputted to the above gear from a pinion gear, not shown, of the boring motor M1. The boring motor M1 uses a stepping motor.

Through rotation of the punch 202 at an angular velocity that is identical to the tangential speed of the leading edge portion of the punch 202 and the conveyance speed of the sheet SH, a configuration is achieved in which the sheet SH can be bored while being conveyed.

Boring involves the following mechanism. FIG. 2A is a diagram illustrating a state in which a sheet SH comes into contact with the leading edge portion of the punch 202, and boring is initiated. In the explanation that follows, this state will be referred to as a boring start position. FIG. 2B is a diagram illustrating a state in which the leading edge portion of the punch 202 and the die 205 completely fit with each other, and boring of the sheet SH is complete. In the explanation that follows, this state will be referred to as a boring completion position. FIG. 2C is a diagram in which the leading edge portion of the punch 202 is completely withdrawn from the sheet SH after boring is over. In the explanation that follows, this state will be referred to as a punch separation position. The terms boring start position, boring completion position and punch separation position will also be used in the explanation of sheet skew correction that is described further on. Simply using expressions such as drilling position or boring position, for convenience of explanation, would make the explanation confusing, and accordingly such expressions are not utilized herein.

In terms of boring timing, the sheet can be bored at various hole pitches by causing the punch 202 to rotate at a predetermined timing, after the sheet conveyance direction leading edge detecting device 27 has detected the passage of the leading edge portion of the sheet SH.

As explained above, the rotary punch unit 62 of Embodiment 1 allows boring the sheet while the sheet is being conveyed.

FIG. 3A to FIG. 3H are diagrams illustrating a relationship between the rotation angle of the punch 202 and a signal of the punch position sensor S1. The hole of the die 205 and the punch position sensor S1 are depicted in partial cross-sectional diagrams, for convenience of explanation. The punch position sensor S1 uses a transmissive photosensor. Reference numeral 301 is a light-shielding plate. The light-shielding plate 301 rotates in synchrony with the rotation of the die 205. The reference numeral 302 is a radial-direction center line of the punch 202. The punch position sensor S1 is shielded from light, or lets light through, by rotating coaxially with the center 204 of the die 205 rotating shaft. The role of the punch position sensor S1 will be described in detail after an explanation of state diagrams.

FIG. 3A to FIG. 3E illustrate state diagrams. In the notation of angles in the figures, the state in which the punch 202 fits into the die 205 and is vertically disposed, in FIG. 3C, takes on an angle of 0°. Herein the clockwise rotation direction is taken as positive. FIG. 3F illustrates the state of a signal (PS signal) of the punch position sensor S1. If the sensor is shielded from light, the signal is H, whereas if the sensor lets light through, the signal is L.

Figures 3A, 3B, 3C, 3D, 3E, 3F, 3G, 3H:
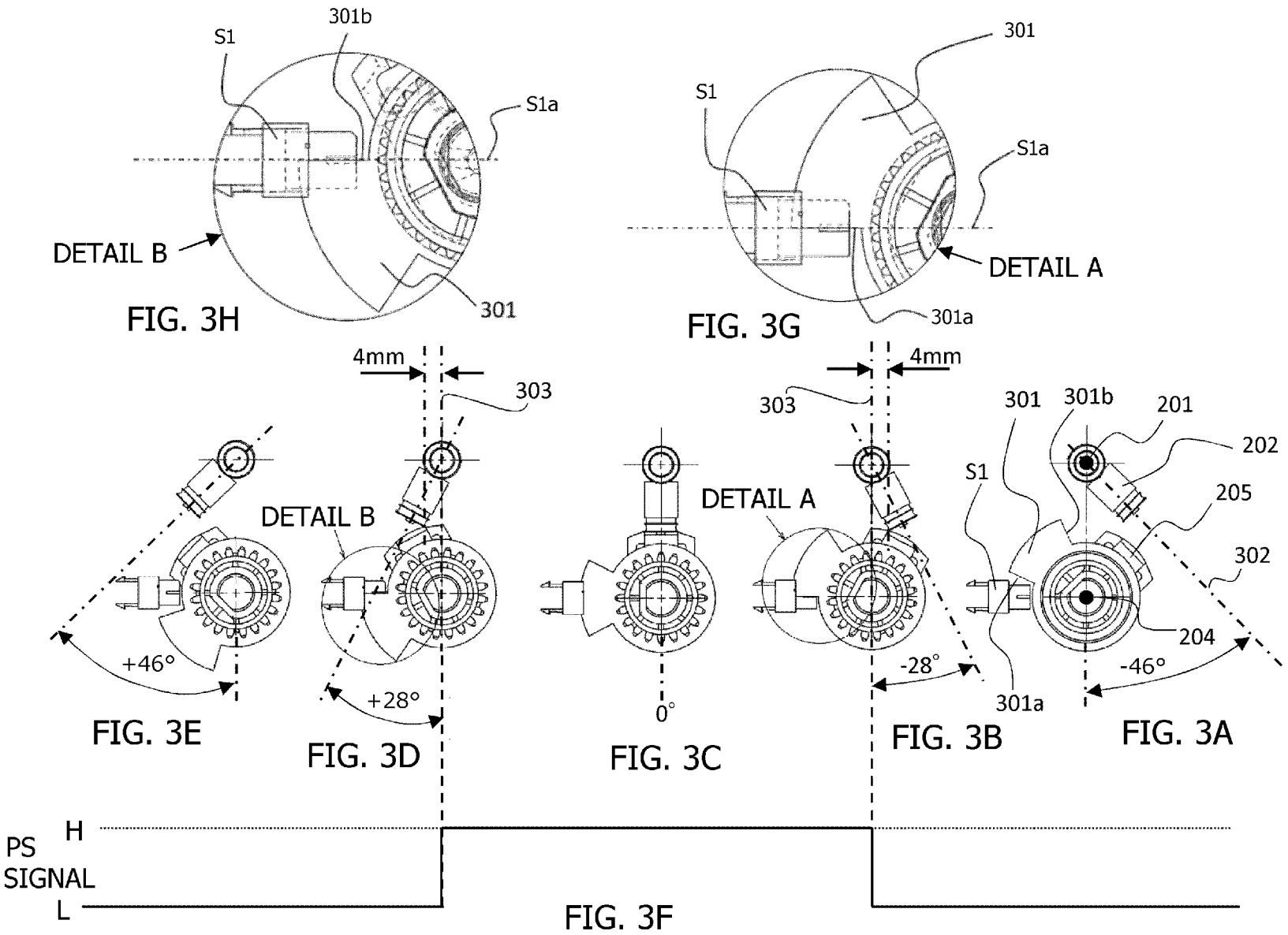
FIG. 3A to FIG. 3H are diagrams illustrating a relationship between a punch rotation angle and a signal of a punch position sensor.

FIG. 3A illustrates −46° from the 0° reference; at this point in time the punch 202 does not mesh with the die 205.

FIG. 3B illustrates −28° from the 0° reference; this is a state diagram in which the punch 202 starts meshing with the die 205. This diagram is the boring start position explained with reference to FIG. 2A to FIG. 2C. This position is a position lying 4 mm upstream from a line joining the center of the rotating shaft of the punch 202 and the center of the rotating shaft of the die 205. The detail A illustrated in FIG. 3G is an enlargement, of part of FIG. 3B, depicting the timing at which a leading edge 301*a* of the light-shielding plate blocks the optical path of a transmissive photosensor. The PS signal changes from L to H at this time.

FIG. 3C illustrates 0°, which is a state diagram in which the radial-direction center axis 302 of the punch 202 and a hole center axis of the die 205 are aligned along a same straight line. This diagram is the boring completion position explained with reference to FIG. 2A to FIG. 2C. In this state diagram a complete hole is formed in the sheet SH.

FIG. 3D, which illustrates +28° from the 0° reference, is a state diagram of the moment where the punch 202 and the die 205 separate from each other. This diagram is that of the punch separation position explained with reference to FIG. 2A to FIG. 2C. This position is a position lying 4 mm downstream from the line joining the center of the rotating shaft of the punch 202 and the center of the rotating shaft of the die 205. The detail B illustrated in FIG. 3H is an enlargement, of part of FIG. 3D, that depicts the timing at which a rear edge 301*b* of the light-shielding plate moves off the optical path of the transmissive photosensor. The PS signal changes from H to L at this time.

FIG. 3E is a state diagram rotated by +46° from the reference.

The roles of the punch position sensor S1 are explained below. The reference numeral 301 is the light-shielding plate, the reference numeral 301*a* is the light-shielding plate leading edge, the reference numeral 301*b* is a light-shielding plate rear edge, and the reference numeral S1*a* is a detection position of the punch position sensor. As explained above, the state of the punch 202 fitted in the die 205 and vertically disposed, in FIG. 3C, is taken as the 0° reference.

The punch position sensor S1 has three roles. The first role is to establish a pulse origin of the punch 202 at a signal switching point; in the present embodiment, a pulse home position of the boring motor M1 is established at the signal switching point in FIG. 3B. Pulse deviation is calibrated, by setting the pulse count to zero, each time that this point is passed.

The second role is to ascertain whether the punch 202 is meshed with the die 205 or not. In the state of FIG. 3B, the light-shielding plate leading edge 301*a* cuts off the punch position sensor S1*a*, the signal of the punch position sensor S1 flips to H, and the punch 202 starts meshing with the die 205. Thereafter, in the state of FIG. 3D, the rear edge 301*b* of the light-shielding plate passes the punch position sensor S1*a*, the signal of the punch position sensor S1 flips to L, and the punch 202 separates from the die 205. The movement of the punch unit 62 in the width direction of the sheet SH is restricted as long as the signal is H. As a result, the punch unit 62 cannot be moved in a left register direction, and forcible pullout of the sheet being bored by the punch unit 62, arising from acceleration of conveying rollers downstream of the punch unit 62, is forbidden.

When a jam occurs in the punch unit 62 it can moreover be determined whether or not the punch 202 is in contact with the sheet, on the basis of the PS signal. Usability is improved in that a warning or an instruction can be issued to the user, in a case where the punch 202 is in contact with the sheet. As an instruction, for instance the user can be instructed to get the punch 202 out of the area of contact with the sheet, by manually rotating the punch 202. Even if power is turned off and the physical positions of the pulse and the punch 202 are no longer known it is still possible, by checking the signal from the punch position sensor S1, to determine whether the position of the punch 202 is or not at a region where the punch 202 touches the sheet; therefore, it becomes possible to reduce the frequency of unnecessary empty meshing between the punch 202 and the die 205 at the time of origin calibration.

The third role is transmitting a trigger signal for accelerating and conveying the sheet SH to the downstream side. Once the punch 202 separates from the final hole in the sheet SH, the sheet SH can be pulled out, with acceleration, and conveyed towards the downstream side. FIG. 3D illustrates that state. In this state, the change of the signal from H to L is used as a trigger.

A further method involves cutting a slit in the light-shielding plate, setting the home positions of the punch 202 and the die 205, and managing the positions on the basis of a pulse. When in this method the interrelationship between the pulse and a physical position is lost, for instance at the time of switching of the power source from off to on, or due to loss of synchronism arising from a jam, it is necessary to search the home position signal by rotating the punch 202 and the die 205. In a case moreover where the punch 202 becomes immobilized through tangling with a sheet, for instance due to a jam, it can no longer be determined whether it is necessary or not to manually rotate the punch 202 and then pull the sheet out. Therefore, such a method has not been resorted to in the present embodiment.

Punch Unit Moving Mechanism

Figure 4A:
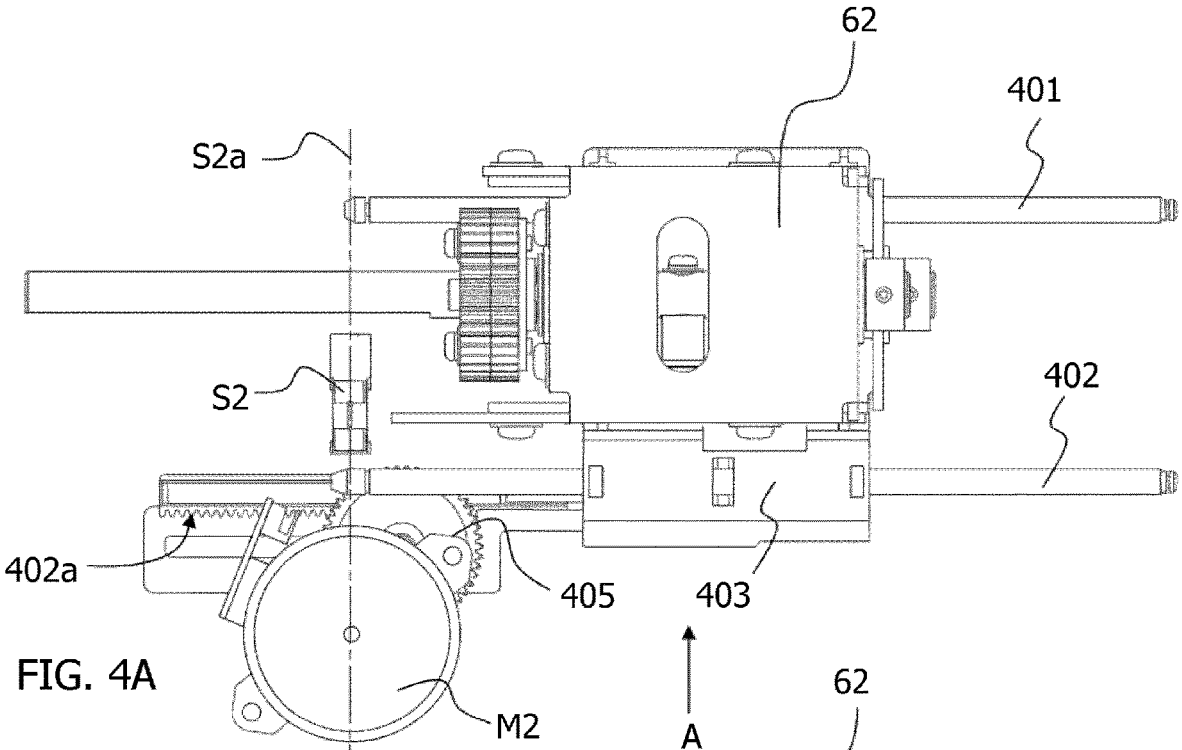
FIG. 4A and FIG. 4B are diagrams illustrating a moving mechanism of a punch unit.
Figure 4B:
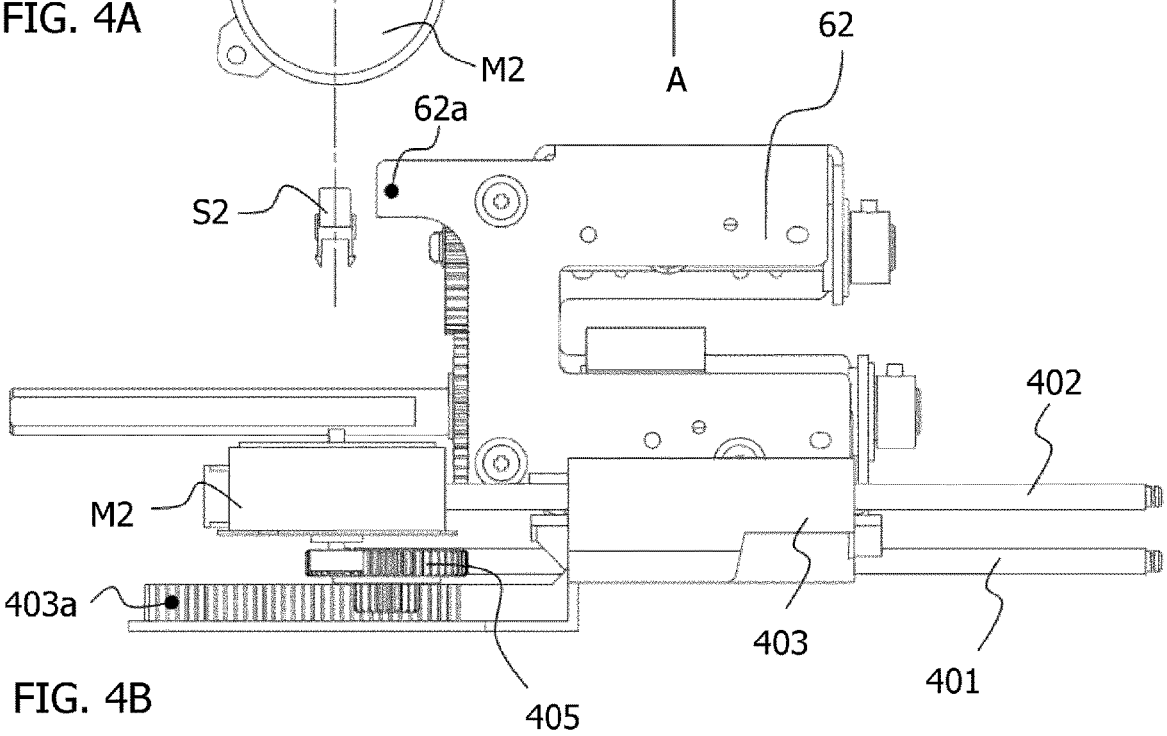

FIG. 4 is a detailed diagram of a mechanism for causing the punch unit 62 to move in the sheet width direction (direction intersecting the conveyance direction of the sheet SH). In FIG. 4A, the sheet SH is conveyed from bottom to top. FIG. 4B is a diagram seen from the direction of arrow A in FIG. 4A.

The mechanism includes a guide shaft 401 and a guide shaft 402, and a punch base portion 403. The punch unit 62 is supported by the punch base portion 403, and the punch base portion 403 is movably supported by the guide shafts 401 and 402 in the sheet width direction (left-right direction in the figure). A portion 403*a* of the punch base portion 403 is a rack gear. The reference numeral 405 is an idler gear between the end position adjustment motor M2 and the rack gear 403*a*.

The end position adjustment motor M2 uses a pulse motor. The reference numeral S2 is the punch end position home position sensor explained with reference to FIG. 2A to FIG. 2C. The punch end position home position sensor S2 is an optical switch having a detection function brought out through blocking of light, by a detection object, between a light-emitting element and a light-receiving element that are arrayed opposing each other in one package. The reference numeral S2*a* is a signal switching position of a time where a skewed object invades the punch end position home position sensor S2.

In terms of the origin of the punch unit 62 in the sheet width direction, the home position is that at the point in time at which a portion 62*a* of the punch unit 62 invades the punch end position home position sensor S2 and reaches the signal switching position of S2*a*. Therefore, S2*a* is also the origin of the punch unit 62 in the sheet width direction.

The position of the punch unit 62 in the sheet width direction is managed on the basis of the number of pulses inputted to the end position adjustment motor M2 from the home position S2*a*.

Operation with a Skewed Sheet SH

Figure 5A:
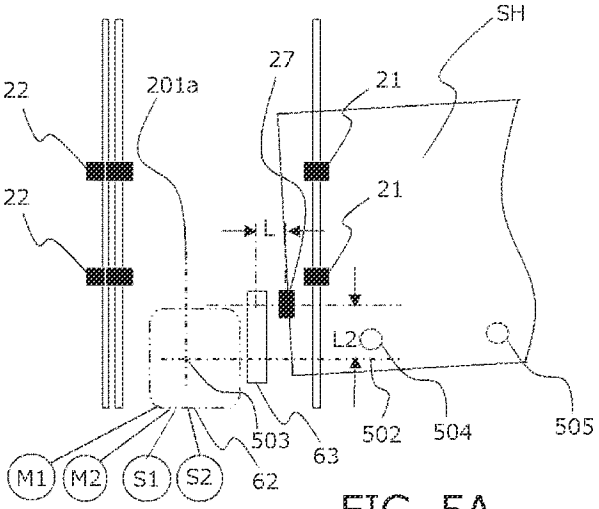
FIG. 5A to FIG. 5H are top-view diagrams for explaining sheet conveyance and a boring step of Embodiment 1.

An expansion follows next on a distance correction method, in a direction perpendicular to the conveyance direction of the sheet SH, in a case where the sheet SH is skewed. FIG. 5A (step a) to FIG. 5H (step h) are all views of FIG. 2A to FIG. 2C, as seen from above. The punch unit 62, which is a rack-and-pinion mechanism explained with reference to FIG. 4A and FIG. 4B, is configured to be movable in a direction perpendicular to the conveyance direction of the sheet SH. In the rack-and-pinion mechanism explained with reference to FIG. 4A and FIG. 4B, a driving force is supplied from the end position adjustment motor M2, the home position is recognized by the punch end position home position sensor S2, and thereafter the position is managed on the basis of a pulse that drives the end position adjustment motor M2. The above is an outline of the width-direction detecting device of the punch.

In the figures, a one-dotted chain line 201*a* denotes a line extending from the center of the punch 202 in the sheet conveyance direction, explained in FIG. 2A to FIG. 2C, at right angles to the conveyance direction. A one-dotted chain line 502 denotes a line extending in the conveyance direction from the center of the punch 202, in the paper width direction, explained with reference to FIG. 2A to FIG. 2C. The reference numeral 503 is the intersection of the rotation center axis 201*a* and an axis 502 of the punch, i.e. is the boring completion position.

As explained with reference to FIG. 1, the sheet conveyance direction leading edge detecting device 27 is disposed in order to detect the passage of the leading and rear edges of the sheet received by the inlet rollers 21, and to detect the presence or absence of a jammed paper sheet.

As explained with reference to FIG. 1, the illumination unit 63 is disposed so as to oppose the line sensor 61, with a sheet conveyance path in between. The line sensor 61 and the illumination unit 63 have the function of detecting the left end portion of the sheet in the conveyance direction. The reference numerals 504 and 505 in the sheet SH are holes. The dotted lines denote respective planned boring positions, and the solid lines denote respective boring completion positions.

FIG. 5A (step a) is a diagram in which the paper leading edge portion of the skewed sheet SH has reached the sheet conveyance direction leading edge detecting device 27. The signal of the sheet conveyance direction leading edge detecting device 27 switches thereupon. This stage precedes boring, and hence the reference numerals 504 and 505 of sheet SH indicate the planned boring positions represented by the dotted lines. A computing unit (or the control unit 200 functioning as a computing unit) starts a timer at the timing of FIG. 5A (step a).

Figure 5B:
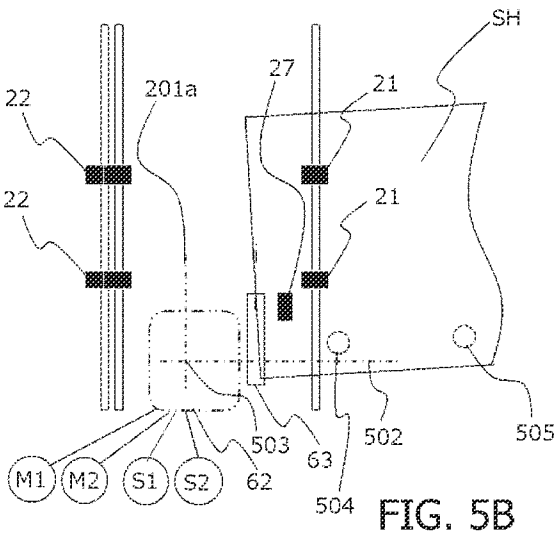

FIG. 5B (step b) is a state in which the leading edge of the sheet SH has reached between the illumination unit 63 and the line sensor 61. The line sensor becomes shaded since the sheet SH reflects the illumination light at the top. The line sensor 61 scans and detects shading of a cell, not shown, identical to a distance L2 from the axis 502 up to the to the sheet conveyance direction leading edge detecting device 27, to thereby detect that the leading edge portion of the sheet SH has passed over the line sensor 61; the line sensor 61 outputs then this detection result. The timer of the computing unit is stopped. The computing unit calculates the conveyance speed of the sheet on the basis of a value of the timer (i.e. the lapse of time during which the leading edge portion of the sheet SH moves from the detection position of the sheet conveyance direction leading edge detecting device 27 up to the detection position of the line sensor 61), and a distance L between the sheet conveyance direction leading edge detecting device 27 and the line sensor 61. The computing unit performs control to keep constant the conveyance speed of the sheet SH, by modifying the rotational speed of the rollers 21 and 22 according to information on the excess/deficit of conveyance speed.

Figure 5C:
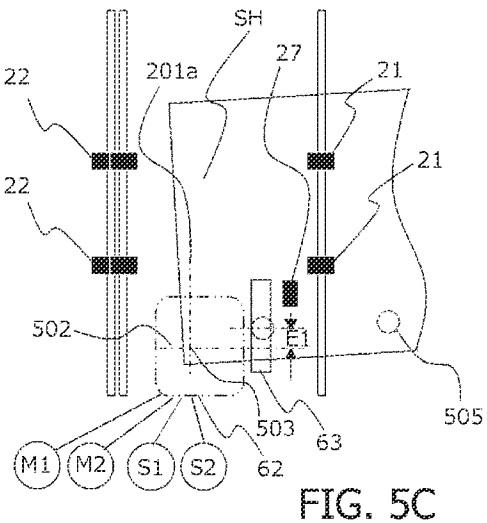

FIG. 5C (step c) illustrates a state in which a planned boring position 504 of the sheet SH has reached the illumination unit 63 and the line sensor 61. At this time a signal for scanning the paper end portion is fed from the control unit 200 to the line sensor 61. The line sensor 61 detects the end position of the planned boring position in the sheet width direction by detecting a boundary position of shading difference on the line sensor, and that appears when the light beam of the illumination unit 63 is reflected by the sheet SH.

Then the computing unit calculates a movement distance E1 from the end position of the planned boring position in the sheet width direction up to the boring completion position 503 of the punch unit 62, the position of which is managed by the above S2 and the motor M2.

Figure 5D:
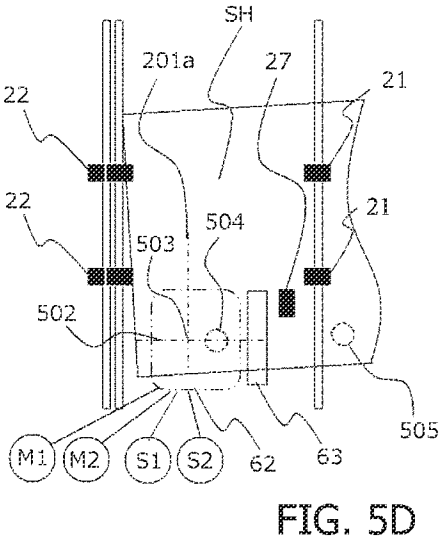

FIG. 5D (step d) is a diagram in which the punch unit 62 is shifted, in the paper width direction, by the punch movement distance E1. At this point in time the planned boring position 504 has not reached the boring start position, 4 mm ahead of the boring completion position 503 explained and defined in FIG. 3B. That is, the leading edge portion of the punch 202 is not in contact with the sheet SH. The punch home position sensor signal in FIG. 3A to FIG. 3H is in the L state.

Figure 5E:
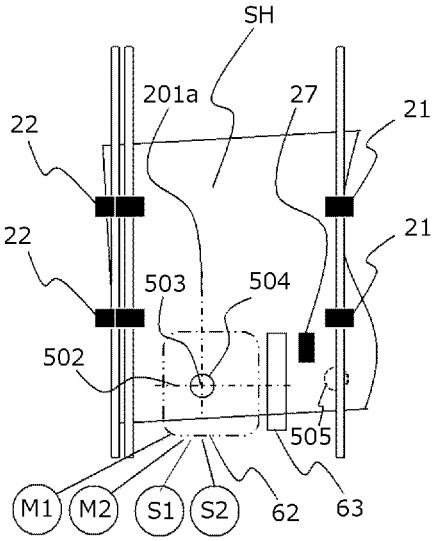

FIG. 5E (step e) is a state diagram in which the center of the planned boring position 504 coincides with the punch center axis 201*a* in the sheet conveyance direction. The attitudes of the punch 202 and of the die 205 in this state diagram are those of a state where the foregoing have reached the boring completion position defined in FIG. 3C and FIG. 2B. The attitudes of the punch 202 and of the die 205 are identical to the attitudes in FIG. 2B.

Figure 5G:
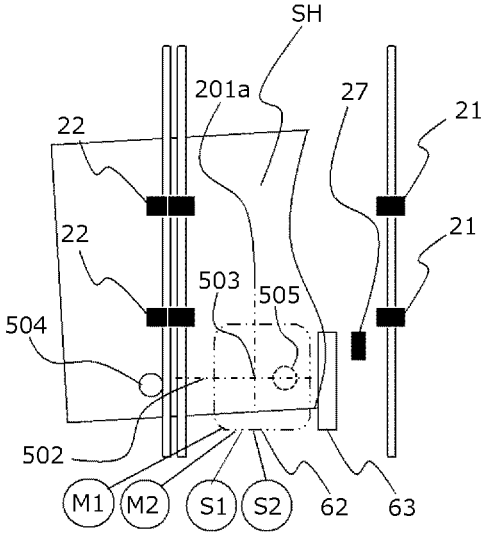
Figure 5F:
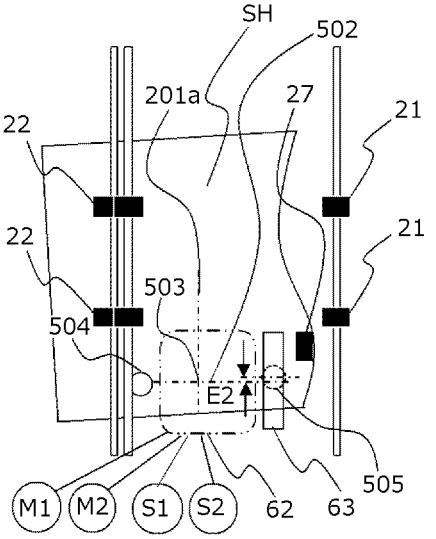

FIG. 5F (step f) is a diagram in which the planned boring position 505 has reached the illumination unit 63 and the line sensor 61. Similarly to FIG. 5C (step c), at this time a signal for scanning the end portion of the sheet SH is fed from the control unit to the line sensor 61, and the line sensor 61 detects the end position of the planned boring position in the sheet width direction by, depending on the presence or absence of the sheet SH, detecting a boundary position of shading difference, on the line sensor, that appears appearing as vignetting of the rays of the illumination unit 63 caused by the sheet SH. The movement distance E2 of the punch unit 62 is calculated by a microcomputer, not shown, on the basis of the end position of the planned boring position in the sheet width direction and the position of the punch unit 62 in the sheet width direction as detected by the width-direction detecting device of the punch.

FIG. 5G (step g) is a diagram in which the punch unit 62 is caused to move by the punch movement distance E2. The movement from FIG. 5F (step f) to FIG. 5G (step g) is identical to the movement from FIG. 5C (step c) to FIG. 5D (step d), and is a movement in a direction perpendicular to the conveyance direction of the sheet SH; accordingly, the movement is completed by the time the leading edge portion of the punch 202 comes into contact with the sheet SH.

Figure 5H:
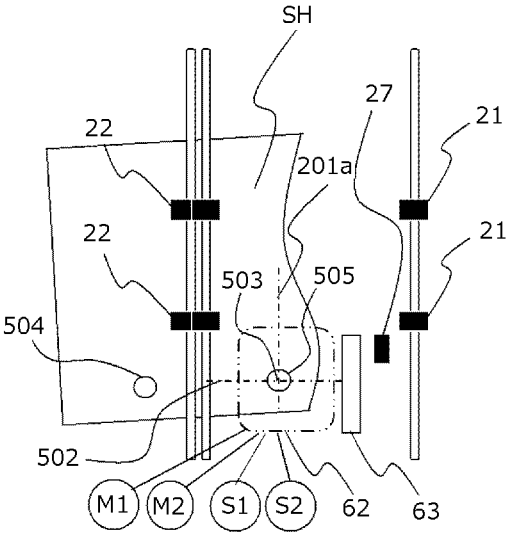

FIG. 5H (step h) is a state in which boring of the hole 2 is complete.

Timing Diagram Prerequisites

Figure 6A:
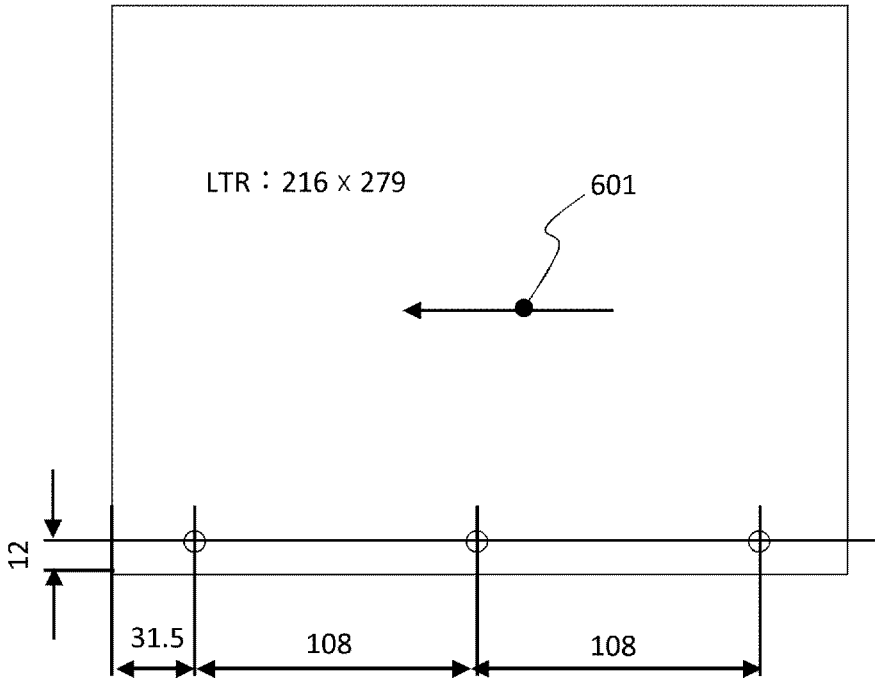
FIG. 6A and FIG. 6B are diagrams for explaining prerequisites of a timing chart of Embodiment 1.

FIG. 6A is a diagram in which three holes are bored in an LTR size (216×279 mm) sheet. Arrow 601 is the paper conveyance direction. The hole diameter is 8 mm. The distance from the end position parallel to the paper conveyance direction up to the center of all the holes is 12 mm. The distances from the end portion in a perpendicular direction, to the center of each hole, are 31.5 mm, 108 mm and 108 mm respectively. A plurality of holes (three in this case) is provided along the conveyance direction.

Figure 6B:
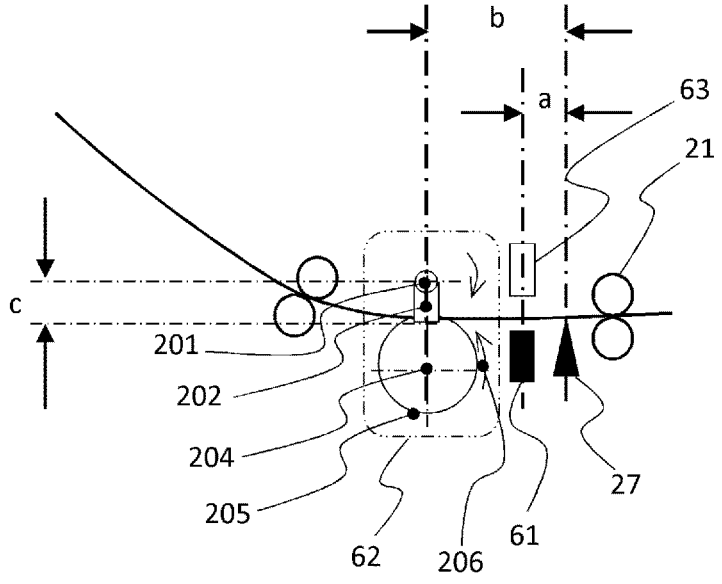

FIG. 6B is a diagram illustrating the positional relationship between the line sensor 61 and the sheet conveyance direction leading edge detecting device 27. Herein distance a is the distance from the sheet conveyance direction leading edge detecting device 27 to the line sensor 61. Further, distance b is the distance from the punch rotating shaft 201 to the sheet conveyance direction leading edge detecting device.

Timing Diagram Overview

An overview of a timing diagram in Embodiment 1 will be explained with reference to FIG. 7A to FIG. 7E. FIG. 7A is a timing diagram of sheet feature points. The vertical axis represents distance in the sheet conveyance direction, and the horizontal axis represents time. The vertical axis illustrates the positions of the inlet rollers 21, the sheet conveyance direction leading edge detecting device 27, the line sensor 61, the boring start position, the boring completion position, a separation termination, and inlet rollers 22. Herein, the boring start position is a position at which the punch 202 and the die 205 start to fit with each other; this indicates the state in FIG. 2A and FIG. 3B. The boring completion position is a position at which the punch 202 and the die 205 completely fit with each other, the axes of the foregoing are parallel to each other, and the angle definition is 0°; this indicates the state in FIG. 2B and FIG. 3C. The separation termination is a position at which the punch 202 and the die 205 do not completely fit with each other; this indicates the state in FIG. 2C and FIG. 3D. The plotted two-dot chains line illustrate, from the left, the behavior of the sheet leading edge, the center of a first hole, the center of a second hole, the center of a third hole, and the rear edge of the sheet.

FIG. 7B is a time transition diagram of the sheet conveyance direction leading edge detecting device 27. An instance where the sheet SH is directly under the sheet conveyance direction leading edge detecting device 27 is represented by a signal H, and an instance where it is not is represented by a signal L.

FIG. 7C is a time transition diagram of the punch position sensor S1. Contact between the punch 22 and the sheet SH is represented by a signal H, and separation between the punch 22 and the sheet SH is represented by a signal L.

FIG. 7D is a time transition diagram of the end position adjustment motor M2. Operation of the end position adjustment motor M2 is represented by a signal H, and non-operation is represented by a signal L.

FIG. 7E is a time transition diagram of the line sensor 61. Scanning by the sensor is represented by a signal H, and non-scanning is represented by a signal L.

The horizontal axes of FIG. 7B, FIG. 7C, FIG. 7D and FIG. 7E represent time; the time scale is identical in all instances to that in FIG. 7A.

Explanation of a Boring Operation Relying on the Timing Diagram

Herein P0 is a point at which the signal of the sheet conveyance direction leading edge detecting device 27 switches when the leading edge portion of the sheet, conveyed from the image forming apparatus 1 and handed over to the inlet rollers 21, reaches the sheet conveyance direction leading edge detecting device 27.

Further, P1 is a point at which the leading edge portion of the sheet SH passes over the line sensor 61. A cell not shown, identical to the distance L2 from the axis 502 illustrated in FIG. 5A (step a) of the line sensor 61 up to the sheet conveyance direction leading edge detecting device 27, is in the state of FIG. 5B (step b) in which the shading signal switches. The conveyance speed of the sheet SH, calculated from the distance L and the time required to move from FIG. 5A (step a) to FIG. 5B (step b), corresponds to the slope from P0 to P1.

Further, P2 is the central portion of the first hole (planned boring position 504 in FIG. 4A and FIG. 4B) at which line scanning is executed, since the left end passes over the line sensor 61.

Further, P3 denotes that boring of the first hole has started. The attitudes of the punch 202 and of the die 205 of the punch unit 62 are those of the boring start position, being the state illustrated in FIG. 2A.

After execution of P2 and up to P3, the computing unit calculates the movement distance E1 of the punch from the position of the punch unit 62 calculated on the basis of the pulse of the end position adjustment motor M2 and the line scan result by the line sensor 61, and moves the punch unit 62 to E1. Herein Δt1 is the lapse of time until the punch unit 62 starts a deviation correction operation in the sheet width direction, after line scanning, by the line sensor 61, of the end portion in the sheet width direction, on the side of the first planned boring position. From P14 to P15, thereafter, the signal of the end position adjustment motor M2 is H, and the motor is driven.

Further, Δt4 is the lapse of time from the end of the operation in which the punch unit 62 is corrected and moves in the sheet width direction until the start of boring the first hole, as defined in FIG. 2A. This indicates that the operation where the punch unit 62 is corrected and moves in the sheet width direction is over by Δt4 ahead of the start of the boring the first hole, as defined in FIG. 2A.

Further, P4 is a position at which boring of the first hole is completed, and the attitudes of the punch 202 and of the die 205 of the punch unit 62 are those of the boring completion position, i.e. the states illustrated in FIG. 2B and FIG. 3D.

Further, P5 is a position at which the punch 202 is completely separated from the first hole. The attitudes of the punch 202 and of the die 205 of the punch unit 62 are those of the punch separation position, being the state illustrated in FIG. 2C.

In P6 the left end of the center of the second hole passes over the line sensor 61, and accordingly line scanning is executed.

Further, P7 denotes that boring of the second hole has started. The attitudes of the punch 202 and of the die 205 of the punch unit 62 are herein those of the boring start position.

After execution of P6 and up to P7, a microcomputer not shown calculates the movement distance E2 of the punch from the position of the punch unit 62 calculated on the basis of the pulse of the end position adjustment motor M2 and the line scan result by the line sensor 61, and moves the punch unit 62 to E2. Further, Δt2 is the lapse of time until the punch unit 62 starts a deviation correction operation in the sheet width direction, after line scanning, by the line sensor 61, of the end portion in the sheet width direction, on the side of the second planned boring position. Thereafter, from P16 to P17, the signal of the end position adjustment motor M2 is H, and the motor is driven.

Further, Δt5 is the lapse of time from the end of the operation in which the punch unit 62 is corrected and moves in the sheet width direction until the start of boring the second hole, as defined in FIG. 2A. This indicates that the operation where the punch unit 62 is corrected and moves in the sheet width direction is over by Δt5 ahead of the start of the boring the second hole, as defined in FIG. 2A.

Further, P8 is a position at which boring of the second hole is complete, and the attitudes of the punch 202 and of the die 205 of the punch unit 62 are those of the boring completion position.

Further, P9 is a position at which the punch 202 is completely separated from the second hole. The attitudes of the punch 202 and of the die 205 of the punch unit 62 are those of the punch separation position.

In P10 the left end of the center of the third hole passes over the line sensor 61, and accordingly line scanning is executed.

Herein P11 indicates that boring of the third hole has started. The attitudes of the punch 202 and of the die 205 of the punch unit 62 are those of the boring start position.

After execution of P10 and up to P11, a microcomputer not shown calculates the movement distance E2 of the punch from the position of the punch unit 62 calculated on the basis of the pulse of the end position adjustment motor M2 and the line scan result by the line sensor 61, and moves the punch unit 62 to E2. Further, Δt3 is the lapse of time until the punch unit 62 starts a deviation correction operation in the sheet width direction, after line scanning, by the line sensor 61, of the end portion in the sheet width direction, on the side of the third planned boring position. Thereafter, from P18 to P19, the signal of the end position adjustment motor M2 is H and the motor is driven.

Further, Δt6 is the lapse of time from the end of the operation in which the punch unit 62 is corrected and moves in the sheet width direction until the start of boring the third hole, as defined in FIG. 2A. This indicates that the operation where the punch unit 62 is corrected and moves in the sheet width direction is over by Δt6 short of the start of the boring the third hole, as defined in FIG. 2A.

Further, P12 is a position at which boring of the third hole is complete, and the attitudes of the punch 202 and of the die 205 of the punch unit 62 are those of the boring completion position.

Further, P13 is a position at which the punch 202 is completely separated from the third hole. The attitudes of the punch 202 and of the die 205 of the punch unit 62 are those of the punch separation position.

Process Flow

A conveyance speed adjustment flow will be explained next with reference to FIG. 8. The present flow may be applied to sheet processing during paper sheet discharge at the time of ordinary image formation. The present flow may also be executed at a timing different from image formation, for instance at the time of equipment installation or during maintenance. Further, the present invention may be adopted in execution of sheet processing using a sheet processing apparatus, at a timing different from an image formation operation.

Step S101 is the start of the flow. In step S102 the computing unit starts a timer count. The present step corresponds to the timing at which the leading edge portion of the sheet SH reaches the sheet conveyance direction leading edge detecting device 27.

In step S103 the computing unit stops the timer count. This corresponds to the timing at which the line sensor 61 detects the leading edge of the sheet SH. In step S104 the timer count value at the time of count stoppage in S103 is assigned to a variable t internally held in the computing unit.

In step S105 the computing unit calculates a conveyance speed $v_1$ of the sheet and records a roller angular velocity $\theta'_1$ at that time, in the computing unit. A sheet conveyance speed $v_1$ is given by Expression 1. Herein, L is the distance between the sheet conveyance direction leading edge detecting device 27 and the line sensor 61, explained in FIG. 5A (step a). The value assigned in S103 is assigned to t. Herein, the roller angular velocity $\theta'_1$ is the conveyance speed of the inlet rollers 21 in a tangential direction with the sheet.

[Math. 1]

$$v_1 = \frac{L}{t} \quad \text{(Expression 1)}$$

(Expression 1)

In step S106 the computing unit utilizes Expression 2 to calculate a diameter $d_1$ of the roller on the basis of the conveyance speed $v_1$ of the sheet obtained in S105 and the roller angular velocity $\theta'_1$ at that time. The diameter $d_1$ obtained herein is an actual value.

[Math. 2]

$$d_1 = \frac{2v_1}{\theta'_1} \quad \text{(Expression 2)}$$

(Expression 2)

In step S107, next, a sheet conveyance angular velocity deviation Δθ' is calculated using Expression 3. Herein θ' is the angular velocity of an ideal roller and d is the diameter of the ideal roller.

[Math. 3]

$$\Delta\theta' = \theta'_1 - \theta' = \frac{2v_1}{d_1} - \frac{2v}{d} \quad \text{(Expression 3)}$$

(Expression 3)

In step S108, next, a correction amount Δn of the rotational speed of the roller is calculated using Expression 4, on the basis of the sheet conveyance angular velocity deviation Δθ'. In step S109, next, the control unit corrects c to a target rotation speed on the basis of the correction amount Δn of the rotational speed of the roller, to thereby bring the sheet conveyance speed to a target speed. For instance a predetermined target speed stored in a memory or the like can be used as the target speed.

[Math. 4]

$$\Delta n = \frac{60\Delta\theta'}{2\pi} \quad \text{(Expression 4)}$$

(Expression 4)

In step S110 the computing unit clears the timer, and assigns zero to the variable t. In step S111 the conveyance speed adjustment flow is terminated.

As explained above, in the present embodiment the rotational speed of the rollers is controlled, to thereby keep constant the sheet conveyance speed, by calculating the sheet conveyance speed on the basis of the passage time of the leading edge portion of the sheet prior to reaching a boring portion. As a result, an effect is elicited whereby the conveyance speed of the sheet is kept constant, from the first sheet, while unaffected by the length tolerance of the sheet, the diameter tolerance of the conveying rollers, or changes in diameter derived from thermal expansion or wear. Given that the sheet conveyance speed is kept constant, it is accordingly not necessary to set the timing of the punch to be variable; this is also advantageous in terms of simplifying a control program. Moreover, the sheet conveyance direction leading edge detecting device doubles as a jam detection sensor, and the line sensor also has the function of detecting a skew amount at the left end portion of the punch hole; this elicits the effect of reducing the cost of the product.

Variation

A detecting device disposed on the downstream side of the inlet rollers in the conveyance direction is referred to as a first detecting device, and a detecting device disposed further downstream of the first detecting device is referred to as a second detecting device. In this case, the sheet conveyance direction leading edge detecting device 27 in Embodiment 1 is ostensibly the first detecting device, and the line sensor 61 is the second detecting device. However, the same effect can be achieved by swapping the positions in the conveyance direction, and using the line sensor 61 as the first detecting device, and the sheet conveyance direction leading edge detecting device 27 as the second detecting device. That is, a configuration suffices in which at least one of the first detecting device and the second detecting device is a line sensor.

EMBODIMENT 2

Figure 9:
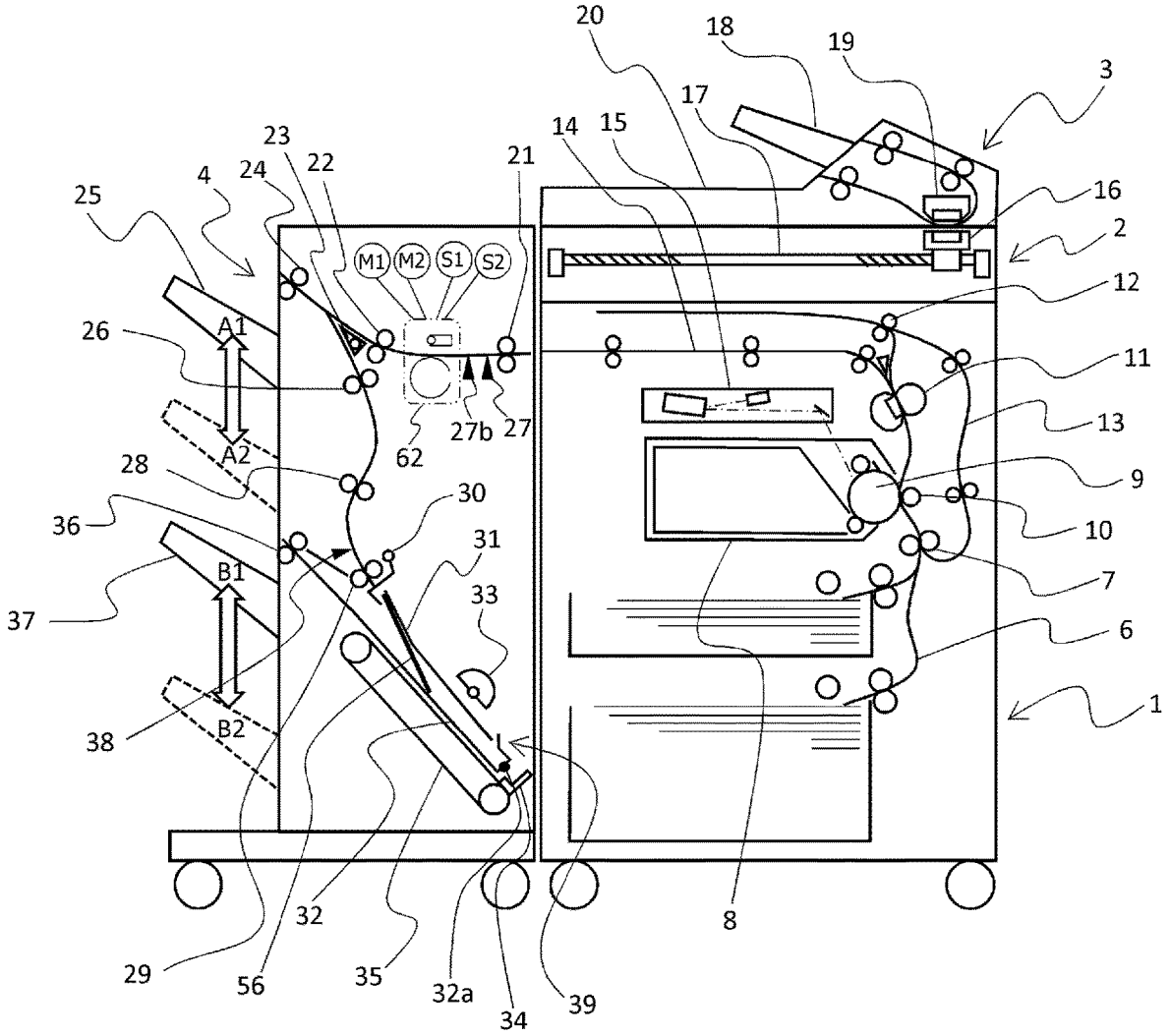
FIG. 9 is a schematic cross-sectional diagram of a sheet processing apparatus and an image forming apparatus of Embodiment 2.

FIG. 9 illustrates a schematic cross section of the image forming apparatus 1, the image reading device 2, the document feeding device 3, and the paper sheet post-processing apparatus 4 in a second embodiment of the present invention. As configuration differences with respect to the first embodiment, herein the line sensor 61 and the illumination unit 63 are absent, and a second sheet conveyance direction leading edge detecting device 27*b* is disposed on the downstream side of the sheet conveyance direction leading edge detecting device 27.

The sheet conveyance direction leading edge detecting device 27 and the second sheet conveyance direction leading edge detecting device 27*b* detect the passage of the sheet leading edge portion, such that the sheet conveyance speed $v_1$ is calculated on the basis of a detection time lag between the two sheet conveyance direction leading edge detecting devices, and on the basis of the distance between the sensors. Next, θ' is calculated as explained with reference to FIG. 8, the correction amount of the rotational speed of the motor is calculated on the basis of the deviation of the sheet conveyance speed, and control is performed so that the sheet conveyance speed is a target speed.

As explained above, the rotational speed of the rollers is controlled, to thereby keep constant the sheet conveyance speed, by calculating the sheet conveyance speed on the basis of a detection time lag of the sheet conveyance direction leading edge detecting device 27 and the second sheet conveyance direction leading edge detecting device 27*b*. As a result an effect is elicited whereby the conveyance speed of the sheet is kept constant, from the second sheet, while unaffected by the length tolerance of the sheet, or by the diameter tolerance or changes in diameter, derived from thermal expansion or wear, of the conveying rollers. Given that the sheet conveyance speed is kept constant, it is accordingly not necessary to set the timing of the punch to be variable; this is advantageous in terms of simplifying a control program.

EMBODIMENT 3

Figure 10:
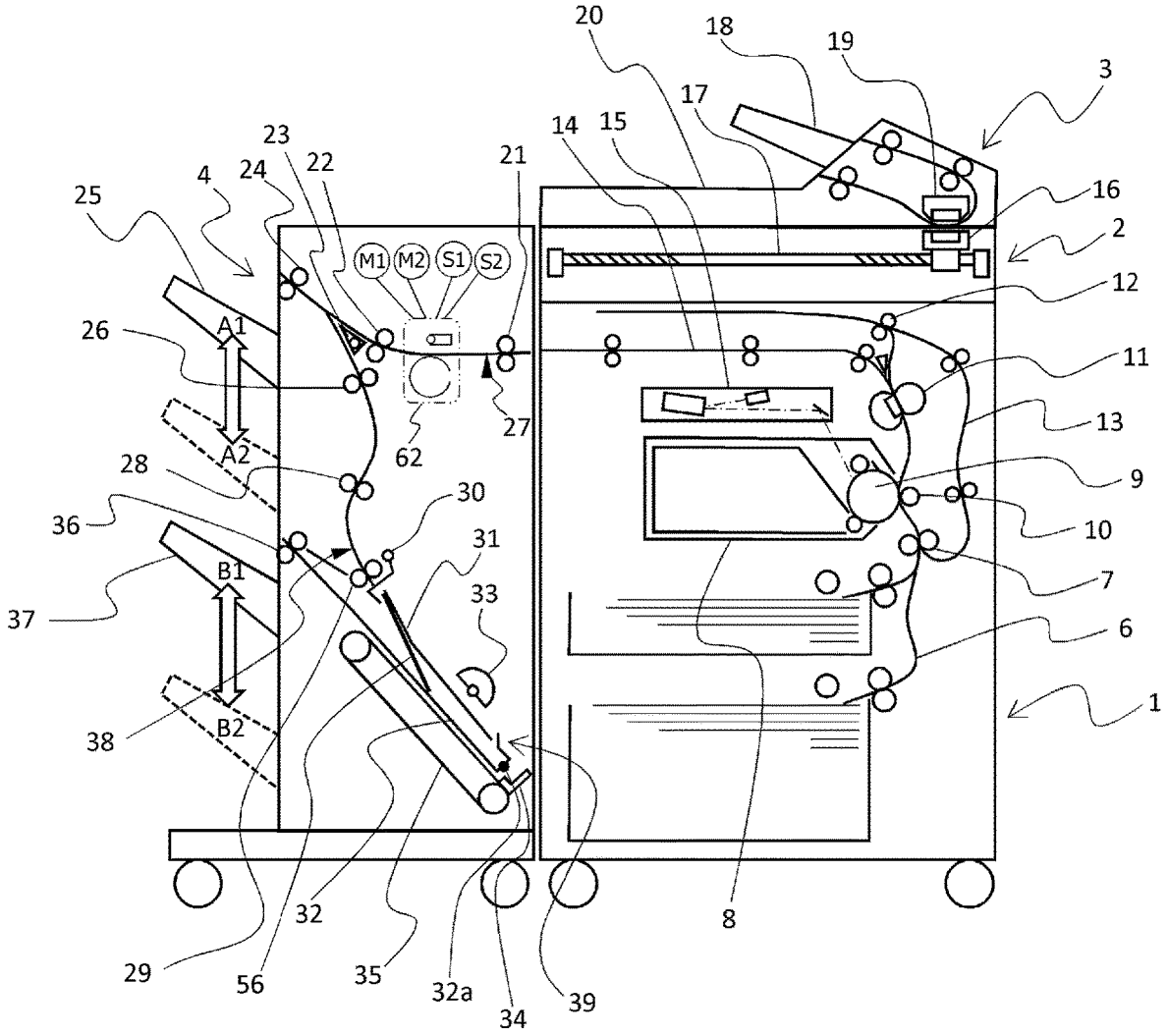
FIG. 10 is a schematic cross-sectional diagram of a sheet processing apparatus and an image forming apparatus of Embodiment 3.

FIG. 10 illustrates a schematic cross section of the image forming apparatus 1, the image reading device 2, the document feeding device 3, and the paper sheet post-processing apparatus 4 in a third embodiment of the present invention. As configuration differences with respect to the first embodiment, herein the line sensor 61 and the illumination unit 63 are absent.

Passage of the sheet leading edge portion and rear edge portion is detected by the sheet conveyance direction leading edge detecting device 27, whereupon the sheet conveyance speed $v_1$ can be calculated on the basis of the sheet length and the passage time of the rear edge from the sheet leading edge, as calculated from the above detection timing. Next, θ' is calculated as explained with reference to FIG. 8, the correction amount of the rotational speed of the motor is calculated on the basis of a deviation of the sheet conveyance speed, and control is performed so that the sheet conveyance speed is a target speed.

As explained above the rotational speed of the rollers is controlled, to thereby keep constant the sheet conveyance speed, by calculating the sheet conveyance speed on the basis of the passage time of the leading edge portion and of the rear edge portion of the sheet, and on the basis of sheet length. As a result, an effect is elicited whereby the conveyance speed of the sheet is kept constant, from the second sheet, while unaffected by the length tolerance of the sheet, or by the diameter tolerance or changes in diameter, derived from thermal expansion or wear, of the conveying rollers. Given that the sheet conveyance speed is kept constant, it is accordingly not necessary to set the timing of the punch to be variable; this is advantageous in terms of simplifying a control program.

EMBODIMENT 4

Figure 11:
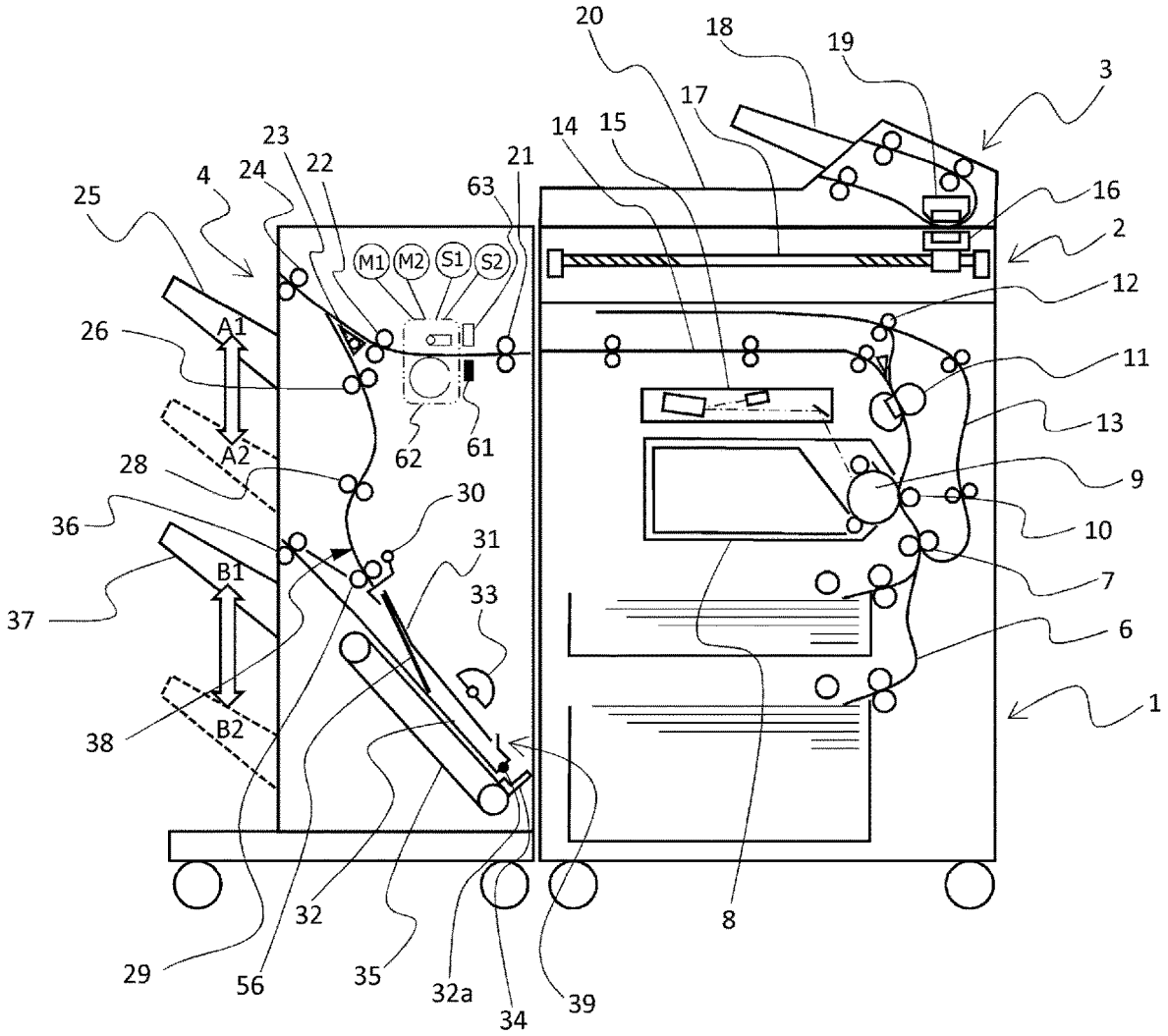
FIG. 11 is a schematic cross-sectional diagram of a sheet processing apparatus and an image forming apparatus of Embodiment 4.

FIG. 11 illustrates a schematic cross section of the image forming apparatus 1, the image reading device 2, the document feeding device 3 and the paper sheet post-processing apparatus 4 in a fourth embodiment of the present invention. As a difference with respect to Embodiment 1, herein there is no sheet conveyance direction leading edge detecting device 27; other features are the same.

The line sensor 61 assumes also the function of the sheet conveyance direction leading edge detecting device 27, and further detects the sheet rear edge portion. Detection of the leading edge and the rear edge involves scanning only of a cell at a distance L2 from the axis 502 in FIG. 5A. The same operation is repeated if there is no change in a shading signal of the cell. If there is a change in the shading signal of the cell, the signal detected for the leading edge is fed to a computing unit, not shown.

Figure 8:
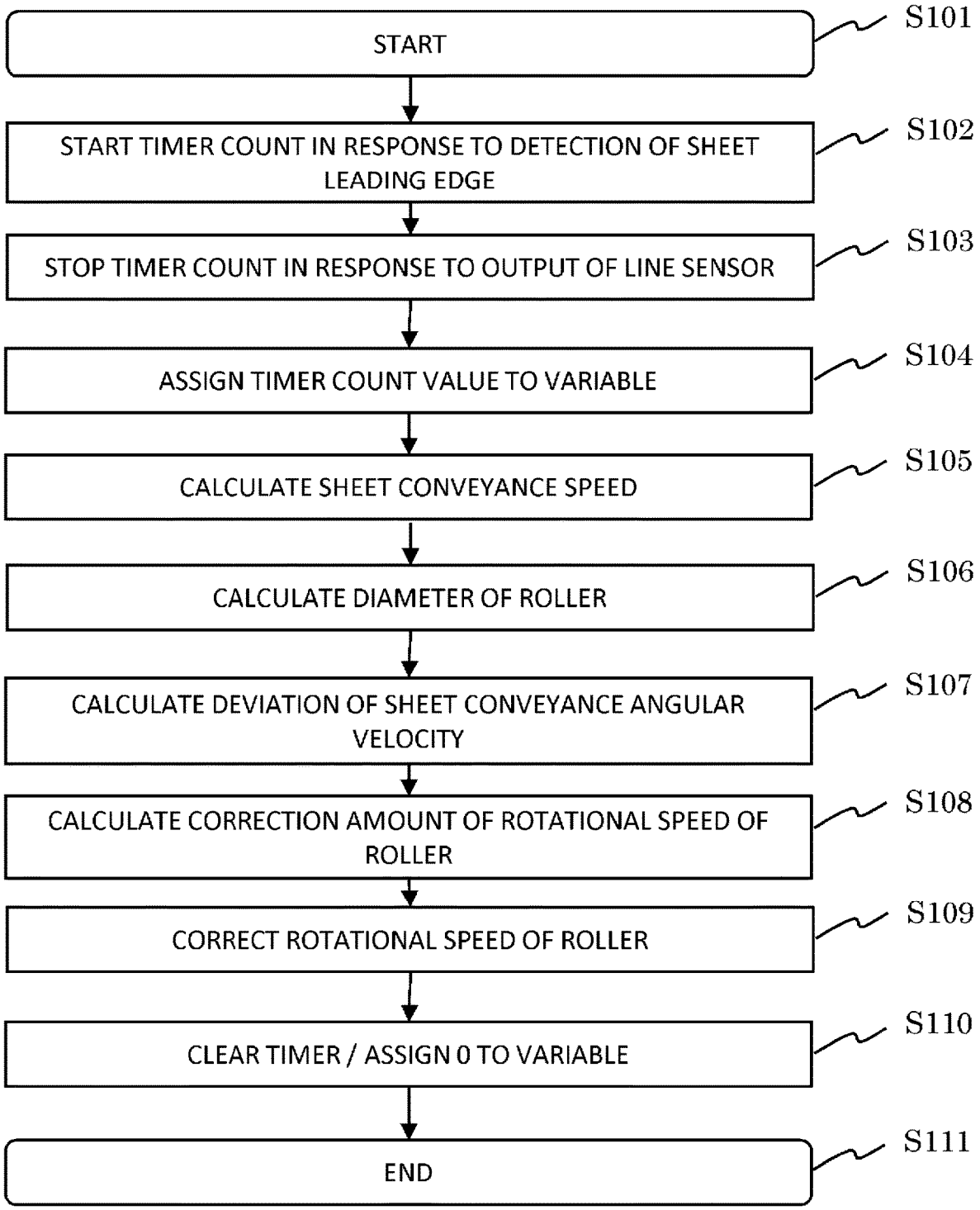
FIG. 8 is a flow chart of conveyance speed adjustment in Embodiment 1.

The computing unit not shown calculates the conveyance speed $v_1$ of the sheet on the basis of the times of passage of the sheet leading edge and rear edge, and on the basis of the length of the sheet, calculates θ' as explained with respect to FIG. 8, and calculates a rotational speed correction amount of the motor on the basis of a deviation of the sheet conveyance speed, and performs control so that the sheet conveyance speed is a target speed.

As explained above the rotational speed of the rollers is controlled, to thereby keep constant the sheet conveyance speed, by calculating the sheet conveyance speed on the basis of the passage time of the leading edge portion and of the rear edge portion of the sheet, and on the basis of sheet length. As a result, an effect is elicited whereby the conveyance speed of the sheet is kept constant, from the second sheet, while unaffected by the length tolerance of the sheet, or by the diameter tolerance or changes in diameter, derived from thermal expansion or wear, of the conveying rollers. Given that the sheet conveyance speed is kept constant, it is accordingly not necessary to set the timing of the punch to be variable; this is advantageous in terms of simplifying a control program.

The line sensor 61 fulfills also the function of the sheet conveyance direction leading edge detecting device 27, and hence the sheet conveyance direction leading edge detecting device 27 is unnecessary, which elicits the effect of further bringing down product costs. In addition, the line sensor fulfills likewise the function of detecting the skew amount of the punch hole left end portion, which as a result elicits the effect of reducing the cost of the product.

In the various embodiments of the present invention, as described above, a detecting device detects, a plurality of times, the leading edge or a rear edge of the sheet in the conveyance direction, whereupon the conveyance speed is calculated and corrected on the basis of the detection results. By virtue of such a configuration, the sheet conveyance speed can be kept constant while unaffected by changes in the diameter of the conveying rollers derived for instance from wear, diameter tolerance and/or thermal expansion. The precision of the boring pitch in the sheet conveyance direction is stabilized as a result. In addition, the burden of calibration on the basis of boring results can be reduced for the user, since the sheet conveyance speed is corrected automatically. Moreover, the boring timing in the sheet conveyance direction need not be made variable, but can be a fixed timing, which allows simplifying the control program. A further effect of product cost reduction is achieved by virtue of the fact that the sheet conveyance direction leading edge detecting device doubles also as a jam detection sensor and as a sensor for measuring amount of sheet skew.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-070412, filed on Apr. 19, 2021, which is hereby incorporated by reference wherein in its entirety.

What is claimed is:

1. A sheet processing apparatus comprising:

a conveying unit, including a roller, configured to convey a sheet in a conveyance direction;

a first detecting device disposed downstream of the conveying unit in the conveyance direction and configured to detect passage of a leading edge of the sheet being conveyed;

a second detecting device disposed downstream of the first detecting device in the conveyance direction and configured to detect passage of the leading edge of the sheet being conveyed;

a boring unit including a punch configured to rotate to bore a hole through the sheet as the punch rotates; and a control unit configured to:

calculate an actual conveyance speed of the sheet based on detection results of the first detecting device and the second detecting device; and control rotation of the roller based on the calculated actual conveyance speed, so that the sheet is conveyed at a same speed as a tangential speed of a leading edge portion of the rotatable punch.

2. The sheet processing apparatus according to claim 1, wherein each of the first detecting device and the second detecting device is any one of a reflective optical sensor, a transmissive optical sensor, a strain detecting sensor, or a line sensor.

3. The sheet processing apparatus of claim 1, further comprising:

a moving unit configured to move the boring unit in a direction that intersects the conveyance direction, wherein at least one of the first detecting device or the second detecting device is a line sensor, and wherein the control unit is configured to:

detect an end portion of the sheet in the conveyance direction based on output of the line sensor;

cause the moving unit to move the boring unit; and control a position of the hole to be bored in the intersecting direction based on the position of the end portion of the sheet.

4. The sheet processing apparatus according to claim 1, wherein the control unit is configured to:

calculate a diameter of the roller based on the calculated actual conveyance speed and an angular velocity of the roller; and correct the angular velocity of the roller based on the calculated diameter of the roller, so that the sheet is conveyed at the same speed as the tangential speed of the leading edge portion of the punch.

5. The sheet processing apparatus according to claim 1, wherein the punch bores a plurality of holes in the sheet along the conveyance direction, with a fixed boring timing.

6. The sheet processing apparatus according to claim 1, wherein the control unit is configured to:

calculate an actual diameter $d_1$ of the roller using the following expression (1), where $v_1$ is the actual conveyance speed of the sheet and $\theta'_1$ is a roller angular velocity of the roller at that time:

$$d_1 = \frac{2v_1}{\theta'_1} \tag{1}$$

calculate a sheet conveyance angular velocity deviation $\Delta\theta'$ using the following expression (2), where $\theta'$ is the angular velocity of an ideal roller and d is the diameter of the ideal roller:

$$\Delta\theta' = \theta'_1 - \theta' = \frac{2v_1}{d_1} - \frac{2v}{d}, \tag{2}$$

and corrects the conveyance speed of the sheet by correcting rotational speed of the roller using a correction amount $\Delta n$ of the rotational speed of the roller calculated using the following expression (3):

$$\Delta n = \frac{60\Delta\theta'}{2\pi}. \tag{3}$$

7. A sheet processing apparatus comprising:

a conveying unit, including a roller, configured to convey a sheet in a conveyance direction;

a detecting device disposed downstream of the conveying unit in the conveyance direction and configured to detect passage of a leading edge and a rear edge of the sheet being conveyed;

a boring unit including a punch configured to rotate to bore a hole through the sheet as the punch rotates; and a control unit configured to:

calculate an actual conveyance speed of the sheet based on respective timings of passage of the leading edge and the rear edge of the sheet, and a length of the sheet in the conveyance direction; and control rotation of the roller based on the calculated actual conveyance speed, so that the sheet is conveyed at a same speed as a tangential speed of a leading edge portion of the punch.

8. The sheet processing apparatus according to claim 7, wherein the detecting device is any one of a reflective optical sensor, a transmissive optical sensor, a strain detecting sensor, or a line sensor.

9. The sheet processing apparatus of claim 7, further comprising:

a moving unit configured to move the boring unit in a direction that intersects the conveyance direction, wherein the detecting device is a line sensor, and wherein the control unit is configured to:

detect an end portion of the sheet in the intersecting direction based on output of the line sensor;

cause the moving unit to move the boring unit; and control a position of the hole to be bored in the intersecting direction based on the position of the end portion of the sheet.

10. A sheet processing apparatus comprising:

a conveying unit configured to convey a sheet in a conveyance direction;

a detecting device configured to detect, at a plurality of times, an end portion of the sheet in the conveyance direction;

a boring unit including a punch configured to rotate to bore a hole through the sheet as the punch rotates; and a control unit configured to:

calculate an actual conveyance speed of the sheet based on respective timings at which the end portion is detected the plurality of times; and control the conveying unit based on the calculated actual conveyance speed, so that the sheet is conveyed at a same speed as a tangential speed of a leading edge portion of the punch.

11. A sheet processing apparatus comprising:

a conveying unit configured to convey a sheet in a conveyance direction;

a detecting device configured to detect an edge portion of the sheet in a conveyance direction a plurality of times;

a boring unit including a punch configured to rotate to bore a hole through the sheet as the punch rotates; and a control unit configured to:

calculate an actual conveyance speed of the sheet based on each timing at which the edge portion of the sheet is detected the plurality of times and a length of the sheet in the conveyance direction; and control the conveying unit based on the calculated actual conveyance speed of the sheet, so that the sheet is conveyed at a same speed as a tangential speed of a leading edge portion of the punch.

12. The sheet processing apparatus according to claim 11, wherein the edge portion of the sheet includes a leading edge of the sheet and a rear edge of the sheet.

* * * * *